US009388801B2

(12) United States Patent
Rietkerk

(10) Patent No.: US 9,388,801 B2
(45) Date of Patent: Jul. 12, 2016

(54) NATURAL GAS COMPRESSOR WITH SCISSOR DRIVE ASSEMBLY

(71) Applicant: Douglas Rietkerk, Edina, MN (US)

(72) Inventor: Douglas Rietkerk, Edina, MN (US)

( * ) Notice: Subject to any disclaimer, the term of this patent is extended or adjusted under 35 U.S.C. 154(b) by 285 days.

(21) Appl. No.: 14/081,713

(22) Filed: Nov. 15, 2013

(65) Prior Publication Data

US 2014/0294635 A1 Oct. 2, 2014

Related U.S. Application Data

(60) Provisional application No. 61/806,532, filed on Mar. 29, 2013.

(51) Int. Cl.
*F04B 27/02* (2006.01)
*F04B 35/01* (2006.01)
*F04B 37/18* (2006.01)

(52) U.S. Cl.
CPC ..... *F04B 27/02* (2013.01); *F04B 35/01* (2013.01); *F04B 37/18* (2013.01)

(58) Field of Classification Search
CPC ..... B66F 7/065; B66F 7/0658; F04B 17/03; F04B 17/05; F04B 27/02; F04B 35/01
USPC ..... 417/415, 521, 343, 364, 374, 529; 92/76, 138, 146, 161; 254/122, 126; 74/89, 89.23, 89.28
See application file for complete search history.

(56) References Cited

U.S. PATENT DOCUMENTS 1,634,062 A * 6/1927 Wilson ..... F25B 31/00 417/439
3,695,788 A * 10/1972 Loomans ..... F04B 3/00 417/488
4,080,874 A * 3/1978 Burkhard ..... F04B 13/02 417/429
4,093,405 A * 6/1978 Brian ..... F04B 17/05 123/197.4
4,232,901 A * 11/1980 Harrington ..... A47C 16/025 108/147
4,344,742 A * 8/1982 Ferris ..... F02B 63/06 123/197.3
4,511,110 A * 4/1985 Moller ..... B66F 7/0658 108/147
4,522,575 A 6/1985 Tischer et al.
4,767,293 A 8/1988 Caillat et al.
4,776,304 A * 10/1988 Korosue ..... F02B 75/222 123/197.4
4,875,838 A 10/1989 Richardson, Jr.
5,006,104 A * 4/1991 Smith ..... F04B 43/06 417/395
5,027,605 A * 7/1991 Hardesty ..... B60H 1/00585 222/341
6,666,657 B2 * 12/2003 Nishikawa ..... F04B 39/0055 417/312
2005/0260080 A1 11/2005 Miura et al.
2009/0191073 A1 * 7/2009 Kopecek ..... F04B 17/04 417/415
2009/0214361 A1 8/2009 Voicu et al.
2011/0129360 A1 * 6/2011 Clinciu ..... F04B 35/01 417/53
2014/0093399 A1 * 4/2014 Pratelli ..... F04B 35/00 417/53
2014/0374680 A1 * 12/2014 Tsang ..... B66F 7/0658 254/7 C

* cited by examiner

*Primary Examiner* — Alexander Comley
(74) *Attorney, Agent, or Firm* — Patterson Thuente Pederson, P.A.

(57) ABSTRACT

A positive displacement reciprocating compressor for compression of natural gas. The compressor includes at least one pair of coaxial bulkheads, each bulkhead having a gas cylinder coupled thereto, and one or more a scissor drive assemblies for driving piston rams into and out of the gas cylinders to compress gas. The scissor drive assembly of the compressor includes one or more piston rams having a piston head attached thereto and movable into and out of each gas cylinder via reciprocating movement of a linkage arm assembly, coupling the piston rams to a rotatable drive shaft. The compressor can be used for compressing natural gas for use as a fuel for vehicles, appliances, generators, or the like.

11 Claims, 2 Drawing Sheets

INTAKE STROKE

COMPRESSION STROKE

NATURAL GAS COMPRESSOR WITH SCISSOR DRIVE ASSEMBLY

RELATED APPLICATION

The present application claims the benefit of U.S. Provisional Application No. 61/806,532 entitled SCISSOR DRIVE NATURAL GAS COMPRESSOR, and filed Mar. 29, 2013, which is incorporated herein in its entirety by reference.

FIELD OF THE INVENTION

Embodiments of the invention related generally to compressors, and more specifically to a scissor drive natural gas compressor.

BACKGROUND OF THE INVENTION

Natural gas is ever increasing in popularity as an alternative to gasoline as gasoline prices continue to rise and/or fluctuate. In particular, compressed natural gas, or CNG, is a readily available alternative to gasoline. CNG costs about 50% less than gasoline or diesel, emits up to 90% fewer emissions than gasoline. CNG is made up mostly of methane, and is odorless, colorless and tasteless. It is produced by compressing natural gas to less than 1% of its volume at standard atmospheric pressure, and is drawn from domestically drilled natural gas wells or in conjunction with crude oil production.

Numerous manufacturers offer or are beginning to offer factory-built CNG trucks, step-vans, transit buses and school buses, and more recently, light-duty cars, vans and pickup trucks. An alternative to purchasing one of these vehicles, consumers can convert their existing vehicles to run on CNG. However, the move for consumers to CNG is somewhat hindered, particularly in the U.S. due to the limited number of refueling stations. Expanding the numbers of CNG fueling stations would allow for the increase of CNG vehicles on U.S. roads. However, it will be some time before the supply or infrastructure of public CNG fueling stations meets demand.

Home fueling stations is one solution for currently refueling a CNG vehicle. However, domestic natural gas lines are not compressed. Therefore, a compressor is needed. Companies are beginning to offer CNG refueling stations or compressors that connect to domestic low-pressure natural gas supply, and that utilized domestic power supply. One such refueling station is commercially available as PHILL supplied by BRC FuelMaker. The PHILL refueling station uses a power supply of 220 Volts, with an average electric consumption of 0.85 kw/hr. The inlet pressure of the gas is 17-35 mbar, and the outlet pressure is about 207 bar or 3.000 psig, with a flow of about 1.5 $sm^3/h$. The current cost is about \$2500-\$5000 for the pump and installation according to publicly available information.

Compressors used to compress natural gas are typically positive displacement reciprocating compressors which utilize pistons driven by a crankshaft. The crankshaft is driven by electric motors or internal combustion engines. The pistons are displaced within a corresponding cylinder to form chambers filled with gas. The pistons reciprocate by moving into and out of the cylinder at a speed determined by the revolutions per minute (RPM) of the crankshaft. As the piston moves into the cylinder, the chamber volume decreases, thereby decreasing the volume of gas, which intern increases the pressure of gas, and the temperature if compressed quickly enough such that heat is not removed at the same or similar rate that it is generated.

Small compressors operate at low-volume and high speeds, and at low horsepower. Low volumes are required because otherwise the amount of forced needed by the piston to compress the gas in the cylinder would be too great to effectively power the compressor. More particularly, because work is equal to force times distance, and horsepower is the rate of work, if a larger volume was utilized, the force and/or distance would increase, thereby increasing the amount of work needed for each cycle, thereby increasing the amount of horsepower to drive the system. Therefore, the speed of the cycle is increased to compensate for the low volume output.

Furthermore, based on the gas laws, compression of a gas increases its temperature, and is referred to as the "heat of compression." In high speed compression systems, it is assumed that the system is adiabatic, in which the compression is happening so quickly that little to no heat is removed from the system during the compression cycle. In this system, the theoretical temperature rise is calculated to be $T_2=T_1(p_2/p_1)^{(k-1)/k}$ where $T_1$ with $T_1$ and $T_2$ in degrees Rankine or kelvins, $p_2$ and $p_1$ being absolute pressures and k=ratio of specific heats. Pressure is related to volume by the relationship $p_2/p_1=(V_1/V_2)^n$, where n is typically between 1 and k. Therefore, to keep the heat of compression in control, smaller volumes are preferred.

Problems with prior art compressors are encountered through the high speed, low volume engineering. For example, as described above, the high speed cycling does not allow for rapid heat dissipation of heat generated from the compression of the gas as well as from friction. Multiple, precision, high speed moving parts require heat dissipation and extensive lubrication to extend the useful life of the compressor. Failures in such compressors can include cracking of the piston and/or cylinder, causing a leak in the chamber.

There remains a need for a slow speed, low horse power, high volume compressor that is economically manufactured, and suitable for use as a residential fueling station for vehicles and/or appliances utilizing CNG.

SUMMARY OF THE INVENTION

Embodiments of the invention disclosed herein relate to positive displacement reciprocating compressors and a simplified construction of such units, which are constructed to reduce the speed and increase the volume per cylinder, thereby reducing the rate of wear and tear of the compressor to increase the useful life. The simplified construction of the units renders them functional for use as compressed natural gas (CNG) home fuel stations for fueling vehicles, appliances, generators, and/or any CNG-fueled application. Such compressors are used for the purpose of raising gas pressure from a given initial pressure, which may be low or atmospheric pressure, to ultra high pressure contained in a separate reservoir.

In one embodiment, a natural gas compressor comprises a mounting frame, at least one pair of coaxially mounted gas cylinders coupled thereto, and a scissor drive assembly including one or more piston ram blocks to urge piston rams and pistons into and out of a corresponding gas cylinder, and a linkage arm assembly adapted to shift the piston rams into and out of the corresponding gas cylinders. The pair of respective gas cylinders are displaced from one another by 180 degrees in rotation along a longitudinal axis of the piston rams such that an open end of the gas cylinders face each other. A piston ram having a piston head attached thereto is movable into and out of each of the cylinders to define a chamber of variable volume within the cylinder. The piston ram corresponding to the first cylinder of the pair is coupled to the other piston ram corresponding to the second cylinder of the pair in reciprocal relationship via the linkage arm assembly.

The linkage arm assembly comprises linkage arms, and more particularly, at least four linkage arms, thereby resembling a scissor lift or scissor jack. The linkage arm assembly is operably connected to a drive shaft, such as a screw, and more particularly, in this case, an acme screw. The linkage arm assembly is shiftable, via rotation of the drive shaft, between a contracted position in which the linkage arms are substantially parallel to the drive shaft, and an expanded position in which the linkage arms are substantially perpendicular to the drive shaft. The pistons rams are mounted and operably connected at one end of the piston ram to the assembly of linkage arms such that as the linkage arm assembly shifts from the contracted position to the expanded position, the piston head attached to the other end of each piston ram moves into its respective cylinder, to compress a gas contained therein, and vice versa.

In embodiments, each linkage arm is coupled to a corresponding piston ram at a first end of the linkage arm via a piston ram block. The second end of each linkage arm is coupled to the drive shaft by a drive block. The drive block is in threaded or geared engagement with the drive shaft that upon rotation of the drive shaft in a first direction, e.g, clockwise, the drive blocks are propelled linearly along the drive shaft toward each other, thereby expanding the linkage arm assembly, thus moving the piston rams with heads into the cylinder, thereby decreasing the chamber volume, and compressing the gas therein (compression cycle). When the drive shaft is rotated in a second direction opposite the first direction, e.g. counterclockwise, the drive blocks are propelled away from each other along the drive shaft, thereby contracting the linkage arm assembly, thus moving the piston heads out of the cylinder, thereby decreasing the pressure in the chamber to allow for new gas (e.g. from a higher pressure source) to enter into the chamber (intake cycle). This back and forth motion simulates the reciprocal motion of compressors of the art.

Due to the configuration of mounting frame, the linkage drive assembly, and particularly the linkage arms, load otherwise placed directly on the crankshaft, or in this case the drive shaft, is distributed throughout the assembly such that the load on the drive block is minimized, allowing for compression of the gas without significantly increasing the work or power requirements. This also allows for slower compression rates, since larger volumes of gas can be compressed in a single cycle.

According to embodiments, a compressor can include one or a plurality of linkage drive assemblies. For example, two or more linkage drive assemblies can be placed in a side-by-side configuration such that they share a common drive shaft. In a particular embodiment, a first drive block of a first drive assembly is coupled to or adjacent to a first drive block of a second drive assembly, each drive block being threadingly engaged with a common drive shaft. As the drive shaft is rotated in a first direction, the first drive block of the first drive assembly moves away from a second drive block of the first drive assembly, such that the first drive assembly shifts from an expanded position to a contracted position (intake cycle). Simultaneously, because the first drive block of the first drive assembly is coupled to the first drive block of the second drive assembly, the first drive block assembly is shifted along the drive shaft towards a second drive block of the second drive assembly, such that the second drive assembly is shifted from a contracted position to an expanded position (compression cycle), opposite the configuration of the first drive assembly. This allows for increased output of the compressor without the need for increased power because the first drive assembly and second drive assembly are alternating cycles. Alternatively, the first drive block of the first drive assembly is the second drive block of the second drive assembly, such that linkages from the first assembly and the second assembly are attached to the single drive block, which allows for the drive assemblies to operate in alternating cycles.

In another embodiment of the invention, one or more drive assemblies are stacked in vertical configuration, and can operate in alternating and/or simultaneous cycling. For example, the vertically stacked drive blocks can optionally be coupled such that stacked drive assemblies operate on the same cycle.

In one embodiment, a compressor includes two or more drive assemblies in side by side configuration, and two or more drive assemblies in stacked configuration. Adjacent side by side drive blocks are couples such that the side by side drive assemblies operate in alternating cycles, while adjacently stacked drive blocks are coupled such that stacked assemblies operate in the same cycle. One of ordinary skill in the art would recognize that any configuration of drive assemblies can be contemplated.

Embodiments of the invention allows one to obtain high pressure gas in a single stage compressor utilizing fewer component parts, at the same time adopting a larger piston ram than conventional compressors, thus increasing the volume of gas per stroke and shortening the time required to fill an independent reservoir, such as the tank of a CNG vehicle.

The above summary of the various representative embodiments of the invention is not intended to describe each illustrated embodiment or every implementation of the invention. Rather, the embodiments are chosen and described so that others skilled in the art can appreciate and understand the principles and practices of the invention.

BRIEF DESCRIPTION OF THE DRAWINGS

The embodiments of the present invention may be more completely understood in consideration of the following detailed description of various embodiments in connection with the accompanying drawings, in which.

Figure 1:
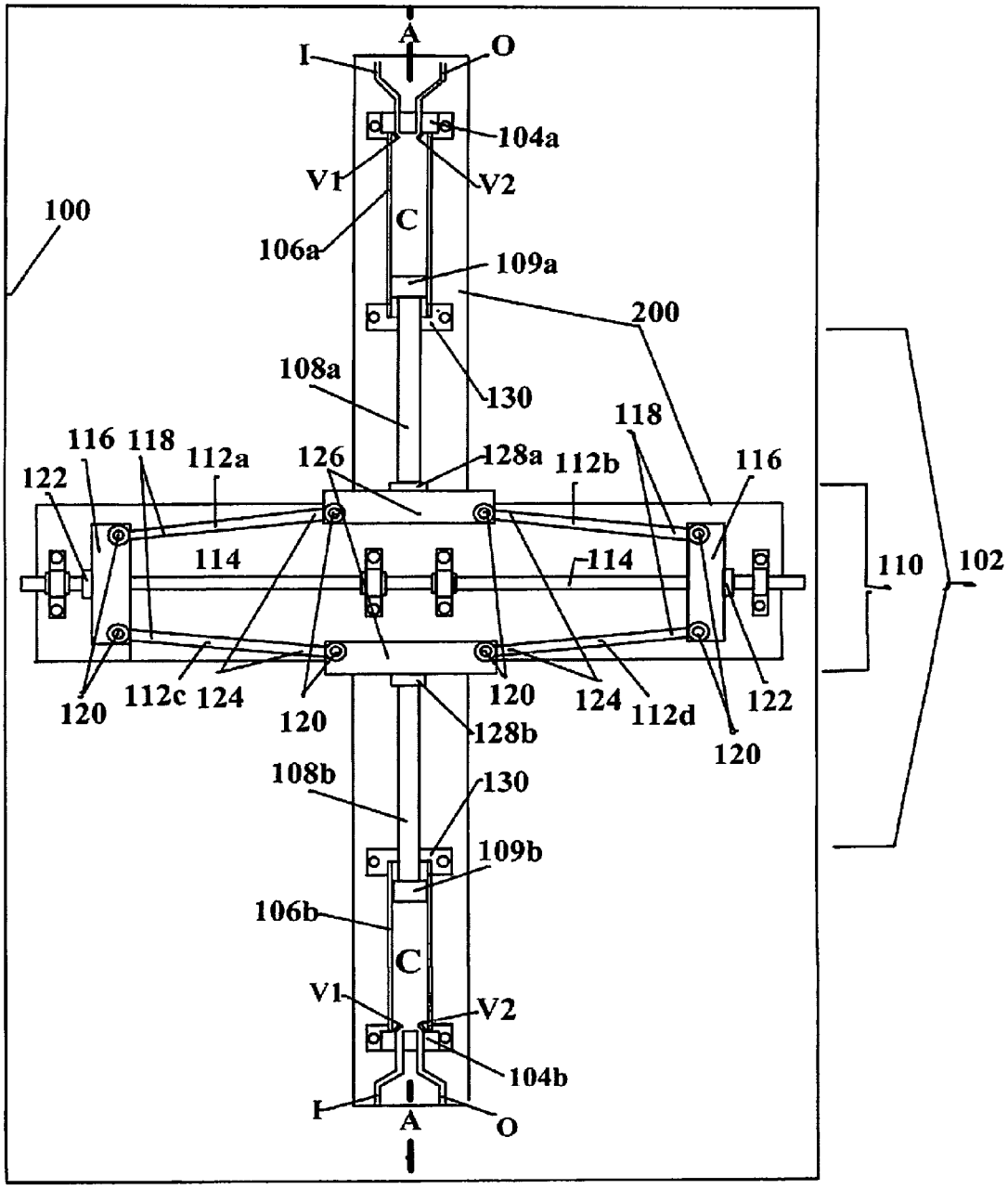
FIG. 1 is a block diagram of an external linkage assembly (scissor) drive natural gas compressor according to an embodiment of the invention.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION

Figure 2A:
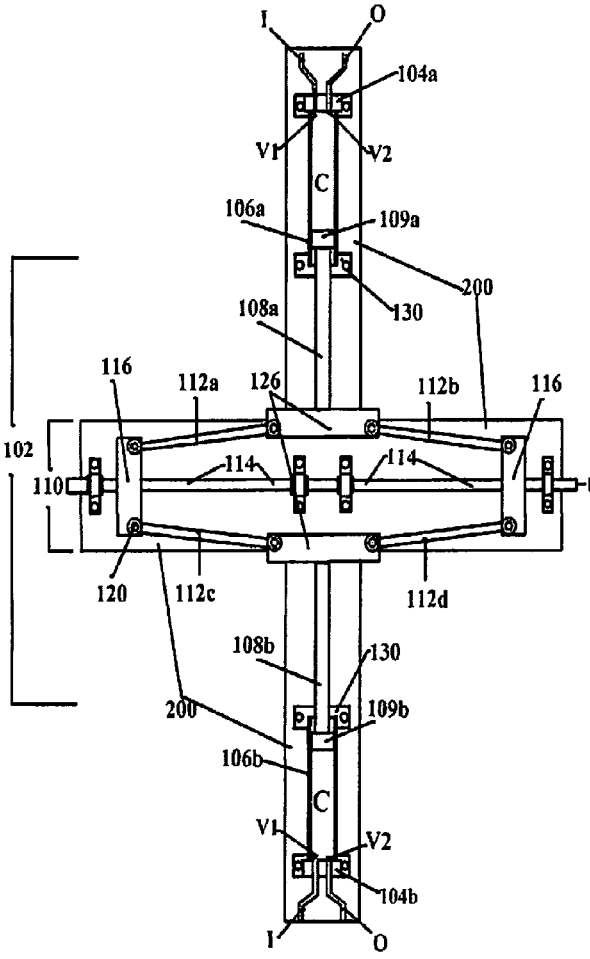
FIG. 2*a* is a top plan view of an external linkage assembly (scissor) drive assembly of a natural gas compressor in a contracted or folded configuration according to an embodiment of the invention.
Figure 2B:
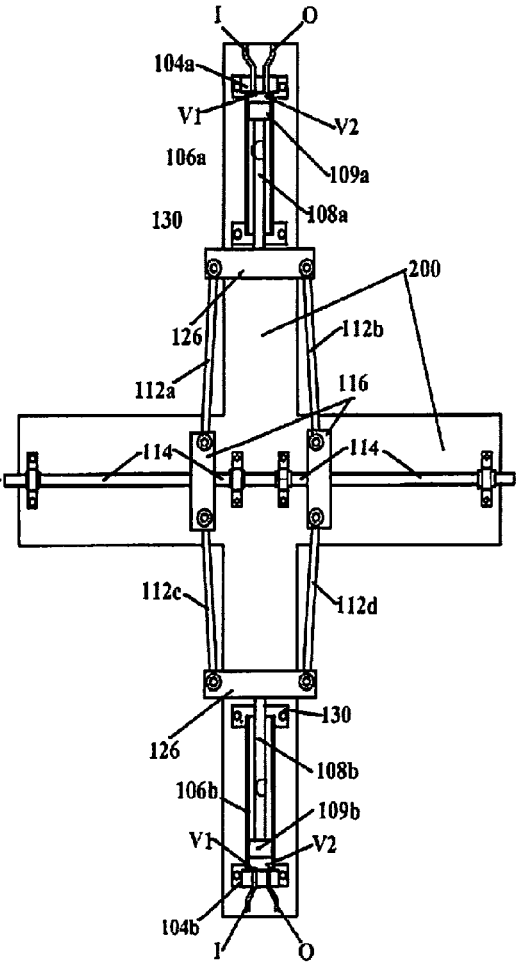
FIG. 2*b* is a top plan view of the external linkage assembly (scissor) drive assembly of FIG. 2*a* in an expanded configuration according to an embodiment of the invention.

According to embodiments, and referring to FIG. 1 and FIG. 2 (made up of FIGS. 2*a*, and 2*b*), a positive displacement reciprocating compressor 100 including at least one pair of coaxial bulkheads 104*a*, 104*b*, each bulkhead 104 having a gas cylinder 106 coupled thereto, and one or more a linkage drive assemblies 110. Compressor 100 can be used for compressing natural gas for use as a fuel for vehicles, appliances, generators, or the like. Linkage drive assembly 110 of compressor 100 includes one or more piston rams 108 with piston head 109 movable into and out of each gas cylinder 106, a linkage arm assembly 112. The sidewalls of cylinder 106, bulkhead 104, and movable piston head 109 define a chamber C of variable volume, dependent on the location of piston head 109.

Referring to FIG. 1, bulkhead 104 has an inlet conduit I coupled to a low pressure natural gas supply, and an outlet conduit O coupled to a reservoir for receiving the high pressure or compressed natural gas. Inlet conduit I is in selective fluid communication with chamber C via a one-way valve V1. When a pressure in chamber C is less than the pressure of the inlet gas in inlet conduit I, one-way valve V1 is forced open to allow the inlet gas into chamber C until the pressure is equalized or greater in chamber C. Similarly, outlet conduit O is in selective fluid communication with chamber C via a one-way valve V2. When a pressure in chamber C is greater than the pressure in outlet conduit O, one-way valve V2 is forced open to allow the compressed gas in chamber C to flow into outlet conduit O into a receiving reservoir until the pressure is equalized. When the receiving reservoir is full, the pressure in outlet conduit O should remain high such that one-way valve V2 remains closed, which in turns signals the compressor to stop operation.

The pair of bulkheads 104*a*, 104*b* and respective cylinders 106*a*, 106*b* are displaced from one another by 180 degrees along a longitudinal axis A of piston rams 108*a*, 108*b*. As described above, piston head(s) 109 attached thereto is movable into and out of its corresponding cylinder 106 along axis A to define a chamber C of variable volume within cylinder 106, as described above. Referring to FIGS. 2*a* and 2*b*, piston ram 108*a* of first cylinder 106*a* of the pair is coupled to piston ram 108*b* of second cylinder 106*b* of the pair in reciprocal relationship via linkage arm assembly 110.

Linkage arm assembly 110 comprises a plurality of linkage arms 112, and more particularly, four linkage arms 112*a*, 112*b*, 112*c*, and 112*d*. Linkage arms 112 are operably coupled or connected to a drive shaft 114, such as a screw, and in this case an acme screw. In one embodiment of the invention, as depicted in FIG. 1, each linkage arm 112 is operably connected to drive shaft 114 via a drive block 116. More particularly, a first end 118 of each linkage arm 112 is rotatable or pivotably coupled via a pin or screw 120 to of drive block 116. Drive block 116 includes a through hole (not shown) through which drive shaft 114 extends. Drive block 116 is secured on drive shaft 114 by a threaded nut 122 attached to block 116.

Linkage arms 112 are also operably coupled or connected to piston ram 108 thereby indirectly coupling drive blocks 116 with the piston rams 108. In one embodiment of the invention, as depicted in FIG. 1, a second end 124 of each linkage arm 112 is rotatable or pivotably coupled via a pin or screw 120 to piston ram block 126. Piston ram 108 is fixed to piston ram block 126 on an end 128 opposite piston head 109.

In one particular embodiment, as shown in FIG. 2*b*, piston ram block 126 is greater in width than a width of cylinder 106 so as to prevent piston ram block 126 from entering cylinder 106. Optionally, cylinder 106 can include a cylinder base or flange 130 for abutting engagement of piston ram block 126 when drive assembly 102 is at the top of a compression cycle.

Linkage arm assembly 110 is shiftable, via rotation of drive shaft 114, between a contracted position as shown in FIG. 2*a*, in which linkage arms 112 are substantially parallel to drive shaft 114 and piston head(s) 109 is at an opening of cylinder 106 so as to allow intake of a gas from inlet conduit I to chamber C, and to an expanded position as shown in FIG. 2*b*, in which linkage arms 112 are substantially perpendicular to drive shaft 114, in which the gas is compressed and allowed to exit into outlet conduit O. Rotation of drive shaft 114 can be accomplished using a standard hydraulic pump, pneumatic mechanism, or mechanical mechanism such as a gear pump or an electric motor.

More particularly, upon rotation of drive shaft 114 in a first direction, e.g, clockwise, drive blocks 116 are translated via nuts 122 along drive shaft 114 toward each other, causing rotation of linkage arms 112 about pivot pins 120, thereby expanding linkage arm assembly 110, and moving piston heads 109 along axis A into cylinders 106, such that the volume of chamber C is decreased, compressing the gas therein to a pressure higher than outlet conduit O to force the compressed gas from chamber C to an external reservoir via outlet conduit O. This is the compression cycle.

When drive shaft 114 is rotated in a second direction opposite the first direction, e.g. counterclockwise, drive blocks 116 are translated away from each other along drive shaft 114, thereby contracting linkage arm assembly 110, and moving piston heads 109 out of cylinders 106, such that the volume of chamber C is increased, creating lower pressure in the chamber to allow for new gas (e.g. from a higher pressure source) to enter into the chamber via the inlet conduit I. This is the intake cycle. This reciprocating motion is repeated until compressor 100 senses that the external reserve is full (i.e. the outlet conduit pressure is always higher than a pressure in chamber C), a maximum pressure in the chamber is reached (e.g. 4000 psig), or it is manually terminated.

In one particular embodiment, as shown in FIG. 2*a*, linkage drive assembly 110 is mounted on a base 200 via standard mounting equipment.

The compressor with linkage drive assembly according to embodiments of the invention allows for larger volumes of gas to be compressed at slower speeds compared to the prior art reciprocating compressors. This is due to the construction of the linkage arm assembly. Similar in construction to a scissor jack or scissor lift, the load on the drive block is redistributed within the system, rather than directly on the drive shaft, thereby reducing the amount of horse power needed to compress the same volume of gas when a straight screw drive is used.

Furthermore, through the linkage drive system's variable speed compression cycle loads on the piston rams and heads is more efficiently distributed than in the reciprocating compressors of the prior art systems. For example, the configuration of the current system according to embodiments, allows for gas to be compressed to about 4000 psig, using a 3.5 inch piston head diameter, and 5 horsepower. Furthermore, because the gas is compressed at speeds much slower, 40 to 50 strokes per minute, than the prior art compressors which operate at speed between 1000 and 1400 strokes per minute, the heat of compression from the rise in temperature due to the Ideal Gas Law (PV=nRT) can dissipate at a rate similar to the rate the temperature rises so that it is nearly or virtually an isothermal compression, thereby reducing the wear and tear on the system, such that the useful life of the compressor is increased over compressors of the prior art.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

What is claimed is:

1. An improved gas compressor for compressing natural gas from a first pressure to a second pressure higher than the first pressure, the compressor comprising:

a mounting frame;

a pair of coaxial gas cylinders displaced along a longitudinal axis and positioned 180 degrees from each other, the gas cylinders being independently mounted to the mounting frame: and a scissor drive assembly including— a first piston ram positioned in a fluid tight configuration in a first gas cylinder of the pair of coaxial gas cylinders, and a second piston ram positioned in a fluid tight configuration in a second gas cylinder of the pair of coaxial gas cylinders, the first and second piston rams being movable within the first and second gas cylinders, respectively, to define a variable internal volume of each gas cylinder;

an externally mounted drive shaft; and an externally mounted linkage arm assembly comprising at least four linkage arms, wherein a first end of first and second linkage arms of the at least four linkage arms is pivotably coupled to the drive shaft via a first drive block, and a first end of third and fourth linkage arms of the at least four linkage arms is pivotably coupled to the drive shaft via a second drive block, and wherein a second opposite end of the first and third linkage arms is pivotably coupled to the first piston ram via a first piston ram block, and wherein a second opposite end of the second and fourth linkage arms is pivotably coupled to the second piston ram via a second piston ram block, and wherein the linkage arm assembly is shiftable, via rotation of the drive shaft, between a folded configuration in which the first and second piston rams are substantially withdrawn from or positioned at a first end of the first and second gas cylinders, respectively, such that the variable internal volume of each gas cylinder is a first initial volume, and an expanded configuration in which the first and second piston rams extend into the first and second gas cylinders, respectively, such that the variable internal volume of each gas cylinder is less than the first initial volume, thereby compressing a gas present within each gas cylinder.

2. The compressor of claim 1, wherein the first and third linkage arms form an obtuse angle, and the second and fourth linkage arms form an obtuse angle when the linkage arm assembly is in the folded configuration, and wherein the first and second pairs of linkage arms form an acute angle, and the third and fourth linkage arms form an acute angle, when the linkage arm assembly is in the expanded configuration.

3. The compressor of claim 1, wherein the first and second drive blocks are spaced apart from each other at a distance greater than a distance extending between the first and second piston ram blocks when the linkage arm assembly is in the folded configuration, and wherein the first and second piston ram blocks are spaced apart from each other at a distance greater than a distance extending between the first and second drive blocks when the linkage arm assembly is in the expanded configuration.

4. The compressor of claim 1, wherein a pressure of a gas in the interior volume of the each gas cylinder is higher when the linkage arm assembly is in the expanded configuration than a pressure of the gas when the linkage arm assembly is in the folded configuration.

5. The compressor of claim 1, wherein each gas cylinder comprises:

structure defining an input conduit, the input conduit selectively fluidly coupling the internal volume of the gas cylinder and a source of low pressure gas; and structure defining an output conduit, the output conduit selectively fluidly coupling the internal volume of the gas cylinder and a reservoir for storing a high pressure gas.

6. The compressor of claim 5, each gas cylinder comprising:

a first valve positioned between the internal volume of the gas chamber and the inlet conduit, wherein the first valve is shiftable between in open configuration when a pressure inside the internal volume of the gas cylinder is lower than a pressure of the source of low pressure natural gas, such that the inlet conduit is in fluid communication with the internal chamber of the gas cylinder to allow low pressure natural gas to flow into the internal chamber, and a closed configuration when a pressure inside the internal chamber is equal to or greater than the pressure of the source of low pressure natural gas, such that the inlet conduit is not in fluid communication with the internal chamber.

7. The compressor of claim 5, each gas cylinder comprising:

a second valve positioned between the internal volume of the gas chamber and the outlet conduit, wherein the second valve is shiftable between in open configuration when a pressure inside the internal volume of the gas cylinder is higher than a pressure of the reservoir, such that the outlet conduit is in fluid communication with the internal chamber of the gas cylinder to allow high pressure natural gas to flow into the reservoir from the chamber, and a closed configuration when a pressure inside the internal chamber is equal to or greater than the pressure of the source of low pressure natural gas, such that the inlet conduit is not in fluid communication with the internal chamber.

8. The compressor of claim 1, wherein a temperature of the gas within each gas cylinder when the linkage arm assembly is in the folded configuration is substantially equal to a temperature of the gas within the gas cylinder when the linkage arm assembly is in the expanded configuration such that the compression of the gas is substantially isothermic.

9. The compressor of claim 1, wherein a pressure of the compressed gas is about 4000 psig.

10. The compressor of claim 1, wherein the mounting frame is configured to be stacked with one or more additional mounting frames to increase a capacity of the compressor.

11. The compressor of claim 1, wherein the independently mounted gas cylinders facilitate ease of repair, replacement, thereby increasing durability compared to non-independently mounted gas cylinders.

* * * * *